US007490912B2

(12) United States Patent
Holl

(10) Patent No.: US 7,490,912 B2
(45) Date of Patent: Feb. 17, 2009

(54) ROUND SHAFT CHISEL

(75) Inventor: Bernd Holl, Neustadt/Wied (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 11/820,491

(22) Filed: Jun. 19, 2007

(65) Prior Publication Data

US 2008/0012419 A1 Jan. 17, 2008

(30) Foreign Application Priority Data

Jun. 23, 2006 (DE) ..... 10 2006 029 300

(51) Int. Cl.
*E21C 35/19* (2006.01)

(52) U.S. Cl. ..... 299/106; 299/110

(58) Field of Classification Search ..... 299/106, 299/107, 110

See application file for complete search history.

(56) References Cited

U.S. PATENT DOCUMENTS 5,810,449 A * 9/1998 Grathoff ..... 299/39.8
7,270,379 B2 * 9/2007 Stehney ..... 299/104
2003/0015907 A1 1/2003 Sollami
2004/0118615 A1 * 6/2004 Beach ..... 175/394

FOREIGN PATENT DOCUMENTS

DE 101 60 668 C2 10/2003
DE 196 24 363 B4 2/2004
EP 1 000 721 B1 8/2003
EP 1 163 424 B1 11/2003
EP 1 216 343 B1 12/2003

* cited by examiner

*Primary Examiner*—John Kreck
(74) *Attorney, Agent, or Firm*—Pauley Peterson & Erickson

(57) ABSTRACT

A round shaft chisel with a clamping sleeve, wherein the round shaft chisel has a chisel head and a chisel shaft rotatably maintained in the clamping sleeve. A pivot bearing is between an inner contour of the clamping sleeve and a shaft contour of the chisel shaft so that a center longitudinal axis of the round shaft chisel is pivotably seated with respect to a center longitudinal axis of the clamping sleeve. As a result of the induced tumbling motion of the round shaft chisel within the clamping sleeve 30, improved dirt removal can be assured during operations. The improved rolling action results in reduced wear between the clamping sleeve and the chisel shaft, which has advantageous results regarding the service life.

17 Claims, 4 Drawing Sheets

ROUND SHAFT CHISEL

BACKGROUND OF THE INVENTION

1. Field of the Invention

This invention relates to a round shaft chisel with a clamping sleeve, wherein the round shaft chisel has a chisel head and a chisel shaft, which is rotatably maintained in the clamping sleeve.

2. Discussion of Related Art

Round shaft chisels are employed, for example, in mining operations to mine minerals or coal, or also in road construction for shaping a line or for removing the cover of a road. In this case a number of round shaft chisels are mounted on a chain or drum and during movement of the latter are engaged with the material to be removed.

The round shaft chisels are advantageously arranged so they are rotatable around their linear axis and achieve an even wear of a chisel head which is fastened to their tip and is equipped with a hard alloy cutting tool. The linear axis of the round shaft chisel can be arranged at an obtuse angle with respect to the movement direction in order to let the occurring forces act primarily in the linear direction and to a lesser degree transversely to the linear axis and to reduce the danger of breaking.

Round shaft chisels can have a cylindrical shaft which, because of tilting forces occurring during its employment, has an inclination toward jamming, which hampers the rotating movement, or to one-sided wear of the shaft or of the bore receiving it.

A disk cutting tool with a chisel holder having an at least sectionally conical receiver, a round shaft chisel and a wear-protection sleeve for receiving the round shaft chisel is known from German Patent Reference DE 101 60 668 C2. The wear-protection sleeve is positioned between the round shaft chisel and the chisel holder. In this case the wear-protection sleeve extends with a section into the receiver and is releasably connected there with the chisel holder.

The section of the wear-protection sleeve extending into the receiver has a conical front end portion and a cylindrical rear end portion. The wear-protection sleeve rests with prestress against the cylindrical inner wall of the receiver. Rock dust entering the gap between the chisel holder and the rotating round shaft chisel can hinder rotation of the round shaft chisel and collect in this area. Uneven wear of the cutting tool attached to the round shaft chisel can thus be caused.

European Patent Reference EP 1 216 343 B1 describes an arrangement for the releasable fixation in place of a round shaft chisel in a chisel bushing. The chisel bushing is releasably fixed in a chisel holder. In this case, the chisel bushing has a conical exterior shape, which is inserted into a corresponding opening in the chisel holder.

During operation, the chisel bushing and the chisel holder are fixedly connected with each other and cannot move in relation to each other. A fluid connection is provided for detachment of the chisel bushing, through which fluid can be introduced under pressure between the chisel bushing and the chisel holder.

German Patent Reference DE 196 24 363 B4 describes a round shaft chisel with a receiver such as published in European Patent Reference EP 1 216 343 B1. Here, the movement of the round shaft chisel in the direction of its axis is also described, which can act on a water supply device for spraying the chisel with water, which can be released by a valve through the chisel.

European Patent Reference EP 1 000 721 B1, U.S. Patent Reference 2003/0015907 and European Patent Reference EP 1 163 424 B1 each respectively describe a chisel holder for a chisel with a cylindrical shaft, wherein a section of the chisel holder with a conical outer contour is inserted into a support block. For being secured against relative rotation, the chisel holder has a flat outer surface in a direction parallel with respect to its longitudinal axis. The penetration of removed material into the area of the conical outer contour is more difficult with a circumferential widening of the chisel holder. The chisel holder has a cross-sectional narrowing, which is used as a predetermined breaking point and, in case of an overload, protects the support block and further structural elements, such as a rotating drum to whose circumference the bearing blocks are affixed. The chisel shaft, and thus the chisel head, are rotatably seated in the chisel holder.

SUMMARY OF THE INVENTION

It is one object of this invention to provide a round shaft chisel of the type mentioned above and in which a lasting rotatability is assured.

This object is attained if a pivot bearing is between an inner contour of the clamping sleeve and a shaft contour of the chisel shaft so that the center longitudinal axis of the round shaft chisel is pivotably seated with respect to a center longitudinal axis of the clamping sleeve. A tumbling motion of the longitudinal axis of the round chisel is made possible by the pivot bearing, which can cause dirt which has penetrated between the chisel shaft and the chisel holder to be removed again, and the mobility of the round chisel is maintained during operation.

In one embodiment which can be produced particularly cost-effectively, the inner contour of the clamping sleeve is cylindrical, at least in the area of the pivot bearing, and the shaft contour bulges out in a direction toward the inner contour of the clamping sleeve.

If the shaft contour of the chisel shaft initially has, starting at the chisel head, a first conical section of a contour, which tapers in the direction toward the chisel head, and a second conical section following it, which has a contour tapering in the direction toward the shaft end. A large contact area with the clamping sleeve is active during tilting of the longitudinal axis of the chisel shaft, similar to a rolling bearing, because of which wear can be reduced.

If the shaft contour of the chisel shaft has a cylindrical section between the first conical section and the second conical section, a securing device can be attached in this cylindrical section, which secures the round chisel against being pulled out in the axial direction.

If the shaft contour of the chisel shaft is barrel-shaped, in particular spherical, dirt which has entered is particularly effectively removed during the tumbling motion, because the gap formed by the tilting of the axes of the chisel shaft and the chisel holder widens in the longitudinal direction of the chisel shaft outward from the center.

If in the area of the shaft contour of maximum shaft diameter a fit between the shaft contour and the inner contour of the clamping shaft is provided, which is $\leqq 0.2$ mm, and if in the area of the tapering shaft diameter a fit in the range between $\geqq 0.2$ mm and $\leqq 0.8$ mm is provided, it is possible to achieve the desired rotatory movement of the chisel shaft which can be maintained with low wear and good cleaning effects in the area between the chisel shaft and the chisel holder.

If a pivot angle between the center longitudinal axis of the round shaft chisel and the center longitudinal axis of the clamping sleeve is up to $\pm 5°$, it is possible for the round shaft chisel to have good effectiveness, low wear of the chisel shaft and at the same time lasting mobility, according to this invention, in the chisel receiver.

Advantageous wear properties of the round shaft chisel and good dissipation of the introduced forces can be achieved if in the pivoted state of the round shaft chisel, a parallel contact zone is formed between the conical section and respectively between the conical section of the shaft contour and the inner contour of the clamping sleeve on the facing side.

It is possible to achieve, along with a cost-effective embodiment, a lasting connection of the round shaft chisel in the chisel holder if the chisel shaft has a circumferential groove in its shaft contour into which, in the mounted state of the round shaft chisel in the chisel receiver, at least one holding element enters, which is cut free from the inner contour of the clamping sleeve.

The desired tumbling motion of the round shaft chisel can be achieved if the groove is arranged in the area of the greatest shaft diameter of the shaft contour.

Effective wear protection of the chisel holder can be achieved by the round shaft chisel having a flange, with a contact face supported on a support face of a wear-protection element, wherein the chisel shaft protrudes through a bore in the wear-protection element. A fit with play is provided between the bore and the chisel shaft so that during the pivot movement of the round shaft chisel the wear-protection element assumes a position in which it lies flat against a front end face of the chisel holder. With the fit with play it is possible to prevent jamming of the wear-protection element during the tumbling motion.

BRIEF DESCRIPTION OF THE DRAWINGS

This invention is explained in greater detail in view of an exemplary embodiment represented in the drawings, wherein.

DETAILED DESCRIPTION OF THE INVENTION

Figure 1:
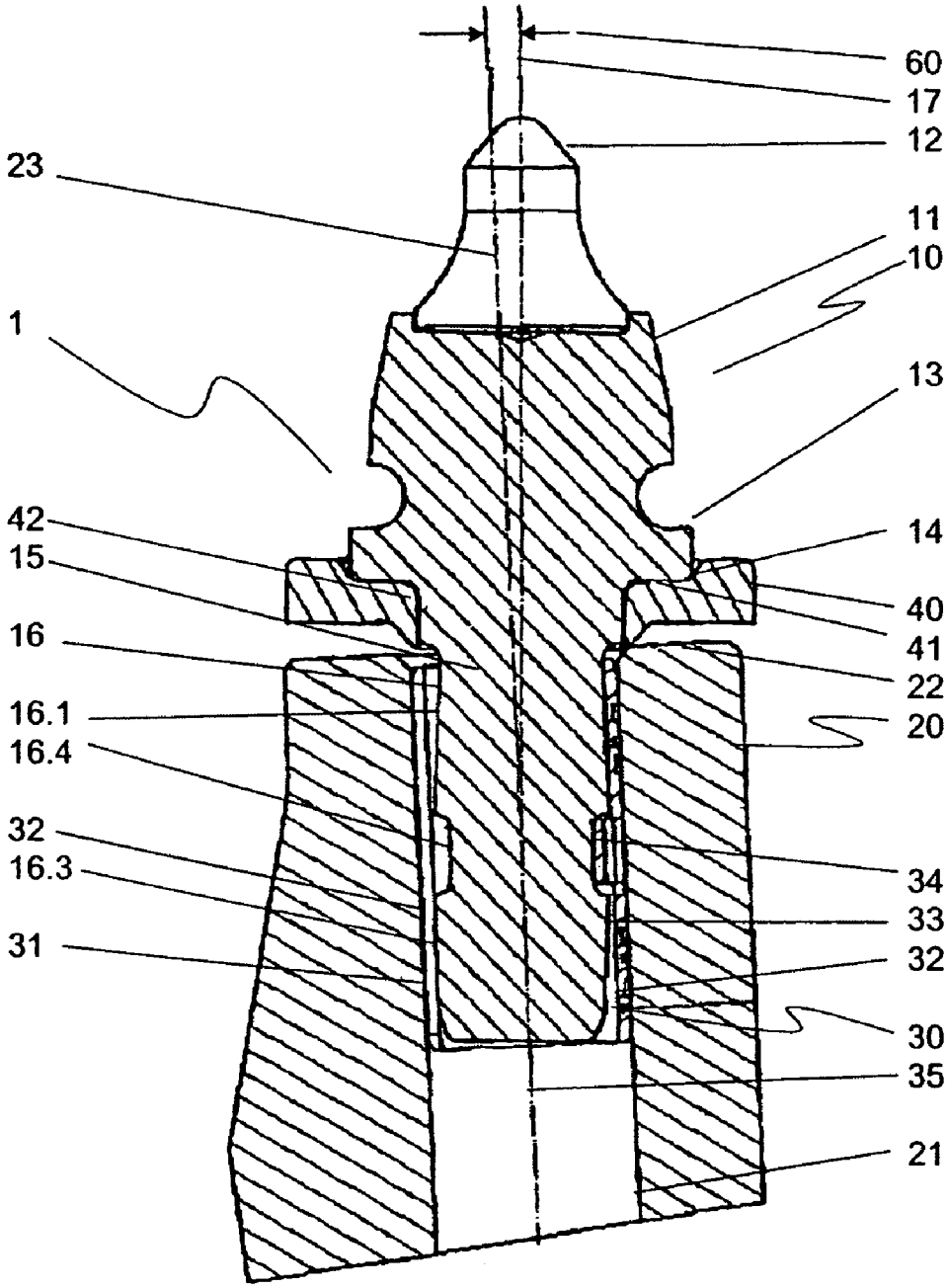
FIG. 1 shows a fastening arrangement for a round shaft chisel in a sectional view.

In a sectional representation, FIG. 1 shows a fastening arrangement 1 for a round shaft chisel 10 having a chisel head 11 which a chisel tip 12 made of, for example, a hard alloy, as well as a chisel shaft 15, which is mounted, rotatably seated, by a clamping sleeve 30 in a chisel receiver 21 of a chisel holder 20.

For simple mounting, the clamping sleeve 30 has a slit 33, which extends parallel with its center longitudinal axis 35, and can be swaged prior to or during the mounting, and subsequently widens after mounting as a result of restoring forces, so that in the mounted state the outer contour 31 of the clamping sleeve 30 enters into a force-locking connection with the inner surface of the chisel receiver 21. The round shaft chisel 10 is supported by a contact surface 14 of a flange 13 on a support surface 41 of a wear-protection element 40. The wear-protection element 40 can be made of a hardened material and prevents in a known manner, in the mounted state, the front end face 22 of the chisel holder 20 from being excessively worn because of the rotating movement of the round shaft chisel 10 during the operation.

As FIG. 1 shows, the wear-protection element 40 has a conical bezel on its underside which in the mounted state engages with an exact fit a conical depression of the end face extending around the chisel receiver 21.

The chisel shaft 15 of the round shaft chisel 10 is formed so that a pivot bearing between an inner contour 32 of the clamping sleeve 30 and a shaft contour 16 of the chisel shaft 15 is such that the center longitudinal axis 17 of the round shaft chisel 10 is pivotably seated with respect to a center longitudinal axis 35 of the clamping sleeve 30, or to a center longitudinal axis 23 of the chisel holder. For one, this is achieved if the inner contour 32 of the clamping sleeve 30 is cylindrical in the area of or near the pivot bearing, and the shaft contour 16 bulges out in the direction toward the inner contour 32 of the clamping sleeve 30. In the example shown, the shaft contour 16 of the chisel shaft 15 is embodied in the manner of a barrel.

In the example shown, the chisel shaft 15 of the round shaft chisel 10 has a circumferential groove 16.4 in its shaft contour 16 which, in the state of the round shaft chisel 10 in which it is mounted in the chisel receiver 21, is engaged by several holding elements 34, which are cut free from the inner contour 32 of the clamping sleeve 30. Thus it is possible to prevent the round shaft chisel 10 from being pulled out in the axial direction of the chisel receiver 21 by the action of axial forces. In the example shown, the groove 16.4 is arranged in the area of or near the greatest shaft diameter of the shaft contour 16.

In the example shown, the shaft contour 16 is laid out with respect to the inner contour 32 of the shaft sleeve 30 so that it is possible to realize a pivot angle 60 of up to ±5° between the center longitudinal axis 17 of the round shaft chisel 10 and the center longitudinal axis 35 of the clamping sleeve 30.

Because of this special design, the round shaft chisel 10 can perform a tumbling motion in the chisel receiver 21 when in use, which favors the flushing of, for example, rubbed-off stone material.

In one embodiment, the wear-protection element 40 has a bore 42, through which the chisel shaft 15 protrudes, wherein a fit with play between the chisel shaft 15 and the inner surface of the bore 42 is formed so that the wear-protection element 40 continues to rest in a flat position on the front end face 22 of the chisel holder 20 during the pivot movement of the round shaft chisel 10.

Figure 2:
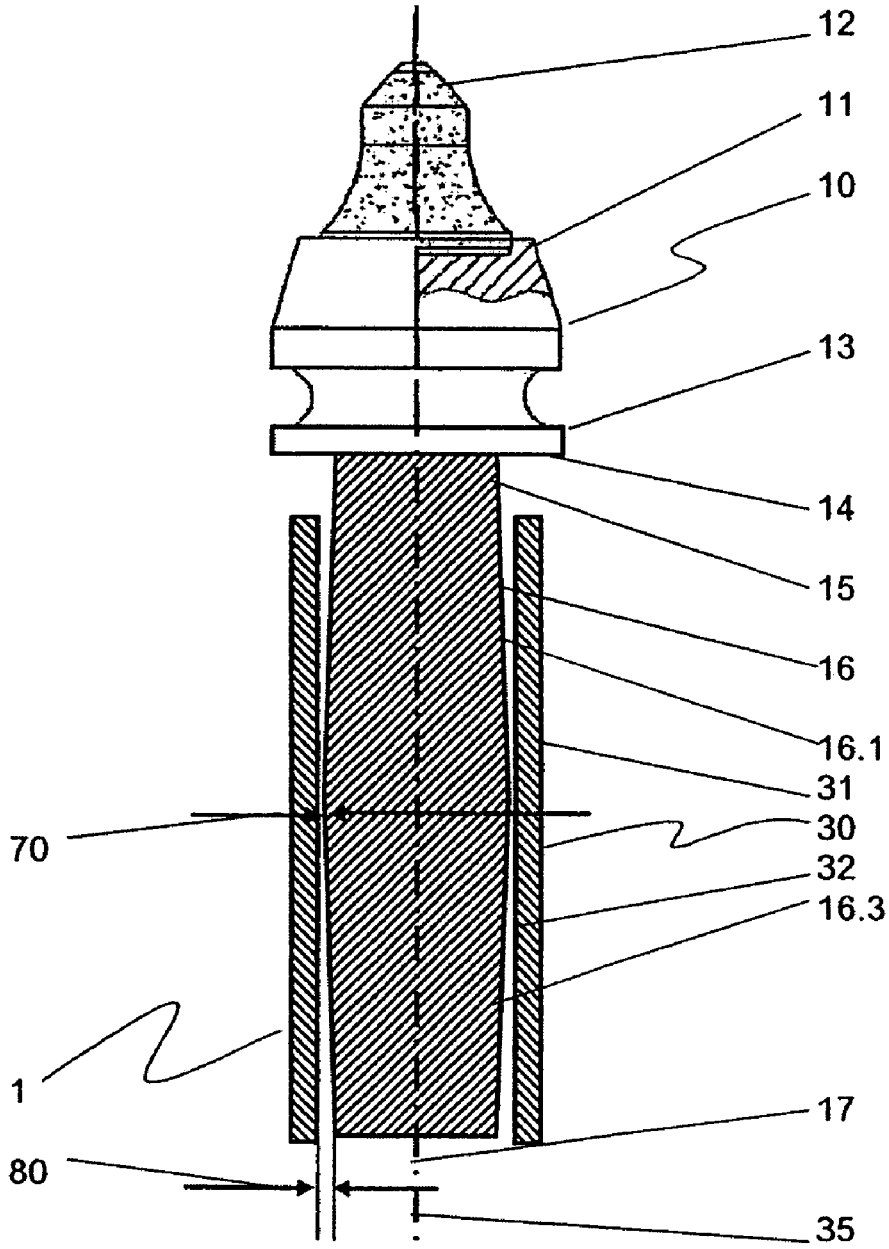
FIG. 2 schematically shows a round shaft chisel with a clamping sleeve.

In contrast to FIG. 1, FIG. 2 represents the round shaft chisel 10 with a chisel shaft 15 and the clamping sleeve 30 in a schematic representation. In this variation, the shaft contour 16 initially has, starting at the chisel head 11, or at the flange 13, a first conical section 16 of a contour tapering in the direction of the chisel head 11 and, following it, a second conical section 16.3 of a contour tapering in the direction toward the shaft end.

FIG. 2 shows the round shaft chisel 10 first in a non-tilted state, in which the center longitudinal axis 17 of the round shaft chisel 10 is identical to the center longitudinal axis 35 of the clamping sleeve 30. In a chisel shaft 15 of a diameter of, for example 20 mm, a fit 70 is provided in the area of or near the shaft contour 16 of maximum shaft diameter, which typically is ≦0.2 mm, preferably ≦0.1 mm. In the area of the tapered shaft diameter, a fit 80 between ≧0.2 mm and, depending on the maximal pivot angle and the diameter of the chisel shaft 15, up to ≦0.8 mm, is provided.

Figure 3:
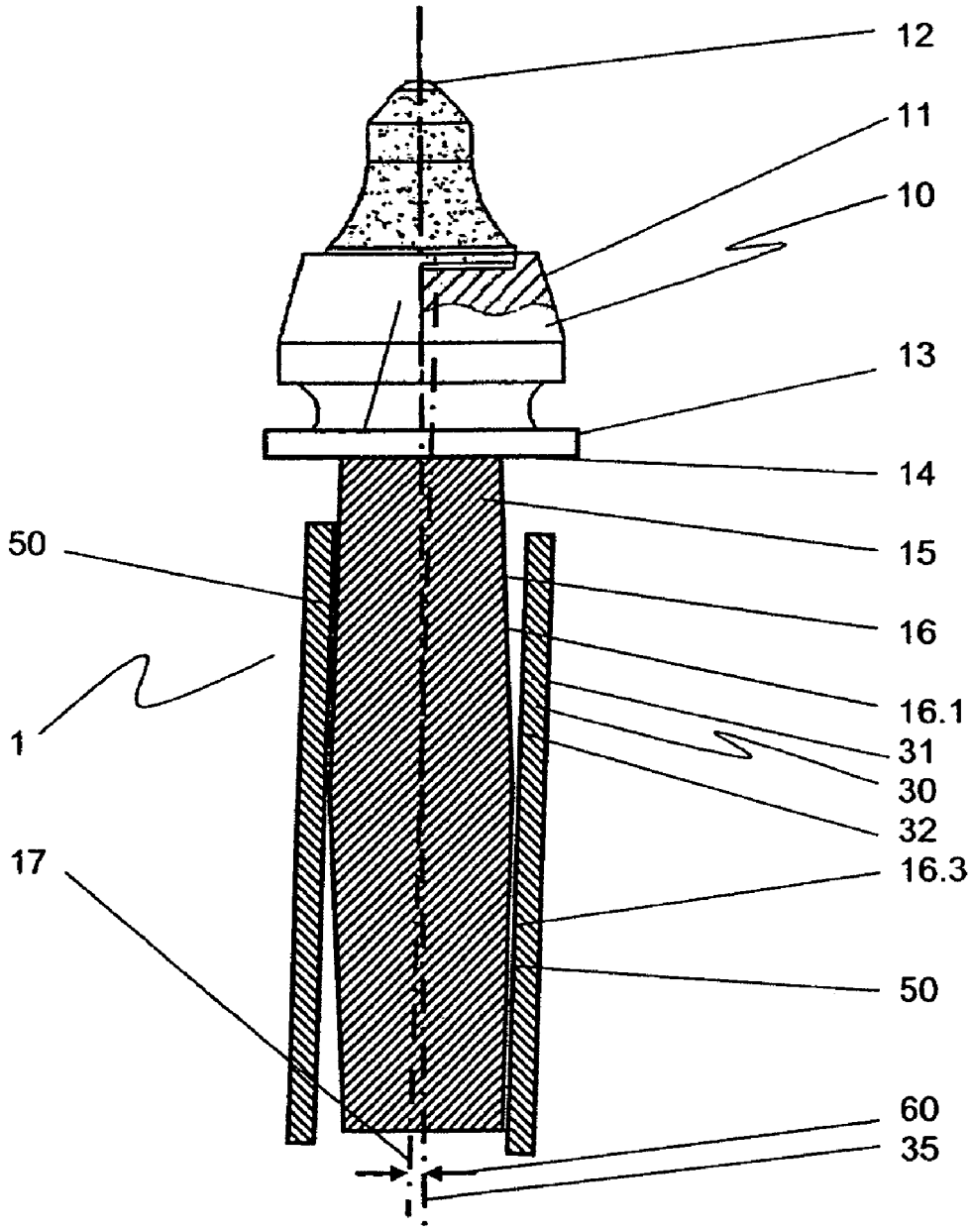
FIG. 3 schematically shows the round shaft chisel pivoted with respect to the clamping sleeve.

In a schematic representation, FIG. 3 shows the round shaft chisel 10, with the characteristics as already represented in FIG. 2 and previously described, in a tilted representation. In this case, the pivot angle 60 between the center longitudinal axis 17 of the round shaft chisel 10 and the center longitudinal axis 35 of the clamping sleeve 30 is up to ±5°.

In the pivoted state of the round shaft chisel 10, a parallel contact zone 50 is formed respectively between the conical section 16.1 and between the opposite conical section 16.3 of the shaft contour 16 and the inner contour 32 of the clamping sleeve 30, because of which the roll-off of the chisel shaft 15 on the inner contour 32 of the clamping sleeve, similar to a rolling bearing, is assured.

Figure 4:
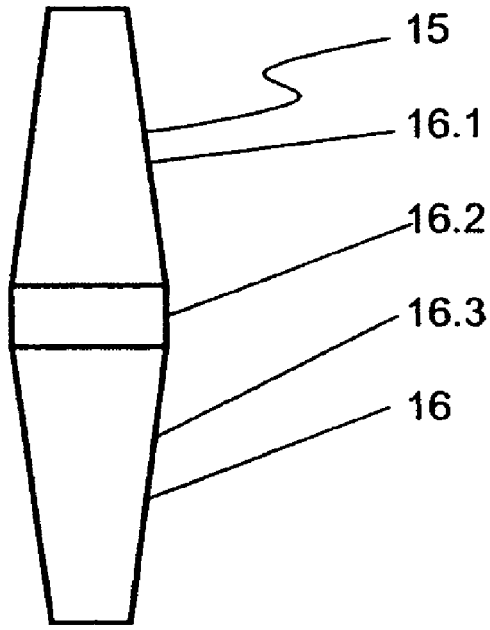
FIG. 4 schematically shows a further embodiment of a chisel shaft.

FIG. 4 shows the shaft contour 16 of the chisel shaft 15 in one embodiment, wherein a cylindrical section 16.2 is provided between the first conical section 16.1 and the second conical section 16.3.

With the special design of the shaft contour 16 with respect to the inner contour 32 of the clamping sleeve 30 it is possible to achieve, as a result of the induced tumbling motion of the round shaft chisel 10 within the clamping sleeve 30, or within the chisel holder 20, improved dirt removal during operations. The improved rolling action leads to reduced wear between the clamping sleeve 30 and the chisel shaft 15, which has advantageous results in regard to the service life.

German Patent Reference 10 2006 029 300.2, the priority document corresponding to this invention, and its teachings are incorporated, by reference, into this specification.

What is claimed is:

1. A round shaft chisel (10) having a clamping sleeve (30), wherein the round shaft chisel (10) has a chisel head (11) and a chisel shaft (15) rotatably maintained in the clamping sleeve (30), the round shaft chisel (10) comprising: a pivot bearing embodied between an inner contour (32) of the clamping sleeve (30) and a shaft contour (16) of the chisel shaft (15) so that a center longitudinal axis (17) of the round shaft chisel (10) is pivotably seated with respect to a center longitudinal axis (35) of the clamping sleeve (30).

2. The round shaft chisel (10) in accordance with claim 1, wherein the inner contour (32) of the clamping sleeve (30) is cylindrical, at least near the pivot bearing, and the shaft contour (16) bulges out toward the inner contour (32) of the clamping sleeve (30).

3. The round shaft chisel (10) in accordance with claim 1, wherein the shaft contour (16) of the chisel shaft (15) has, starting at the chisel head (11), at least one first conical section (16.1) of a contour which tapers toward the chisel head (11), and a second conical section (16.3) following the first conical section (16.1) and having a contour tapering toward a shaft end.

4. The round shaft chisel (10) in accordance with claim 1, wherein the shaft contour (16) of the chisel shaft (15) has a cylindrical section (16.2) between the first conical section (16.1) and the second conical section (16.3).

5. The round shaft chisel (10) in accordance with claim 1, wherein the shaft contour (16) of the chisel shaft (15) is barrel-shaped.

6. The round shaft chisel (10) in accordance with claim 5, wherein near the shaft contour (16) of a maximum shaft diameter a fit (70) between the shaft contour (16) and the inner contour (32) of the clamping sleeve (30) is $\leqq 0.2$ mm, and a fit (80) in a range between $\geqq 0.2$ mm and $\leqq 0.8$ mm is near a tapering shaft diameter.

7. The round shaft chisel (10) in accordance with claim 6, wherein a pivot angle (60) between the center longitudinal axis (17) of the round shaft chisel (10) and a second center longitudinal axis (35) of the clamping sleeve (30) is up to ±5°.

8. The round shaft chisel (10) in accordance with claim 7, wherein in a pivoted state of the round shaft chisel (10), a parallel contact zone (50) is formed between a conical section (16.1) and respectively between a conical section (16.3) of the shaft contour (16) and the inner contour (32) of the clamping sleeve (30) on a facing side.

9. The round shaft chisel (10) in accordance with claim 8, wherein the chisel shaft (15) has a circumferential groove (16.4) in a shaft contour (16) into which, in a mounted state of the round shaft chisel (10) in the chisel receiver (21) at least one holding element (34) enters which is free from the inner contour (32) of the clamping sleeve (30).

10. The round shaft chisel (10) in accordance with claim 9, wherein the groove (16.4) is arranged near a greatest shaft diameter of the shaft contour (16).

11. The round shaft chisel (10) in accordance with claim 10, wherein the round shaft chisel (10) has a flange (13) with a contact face (14) supported on a support face (41) of a wear-protection element (40), the chisel shaft (15) protrudes through a bore (42) in the wear-protection element (40), a fit with play is between the bore (42) and the chisel shaft (15) so that during a pivot movement of the round shaft chisel (10), the wear-protection element (40) assumes a position flat against a front end face (22) of the chisel holder (20).

12. The round shaft chisel (10) in accordance with claim 1, wherein near the shaft contour (16) of a maximum shaft diameter a fit (70) between the shaft contour (16) and the inner contour (32) of the clamping sleeve (30) is $\leqq 0.2$ mm, and a fit (80) in a range between $\geqq 0.2$ mm and $\leqq 0.8$ mm is near a tapering shaft diameter.

13. The round shaft chisel (10) in accordance with claim 1, wherein a pivot angle (60) between the center longitudinal axis (17) of the round shaft chisel (10) and a second center longitudinal axis (35) of the clamping sleeve (30) is up to ±5°.

14. The round shaft chisel (10) in accordance with claim 2, wherein in a pivoted state of the round shaft chisel (10), a parallel contact zone (50) is formed between a conical section (16.1) and respectively between a conical section (16.3) of the shaft contour (16) and the inner contour (32) of the clamping sleeve (30) on a facing side.

15. The round shaft chisel (10) in accordance with claim 1, wherein the chisel shaft (15) has a circumferential groove (16.4) in a shaft contour (16) into which, in a mounted state of the round shaft chisel (10) in the chisel receiver (21) at least one holding element (34) enters which is free from the inner contour (32) of the clamping sleeve (30).

16. The round shaft chisel (10) in accordance with claim 15, wherein the groove (16.4) is arranged near a greatest shaft diameter of the shaft contour (16).

17. The round shaft chisel (10) in accordance with claim 1, wherein the round shaft chisel (10) has a flange (13) with a contact face (14) supported on a support face (41) of a wear-protection element (40), the chisel shaft (15) protrudes through a bore (42) in the wear-protection element (40), a fit with play is between the bore (42) and the chisel shaft (15) so that during a pivot movement of the round shaft chisel (10), the wear-protection element (40) assumes a position flat against a front end face (22) of the chisel holder (20).

* * * * *